US006425849B1

(12) United States Patent
Benson

(10) Patent No.: US 6,425,849 B1
(45) Date of Patent: Jul. 30, 2002

(54) SOLID BOWL CENTRIFUGE WITH LIQUID RELEASE DURING ROTATION

(76) Inventor: Ronald D. Benson, 5413 Tory La., Colgate, WI (US) 53017

( * ) Notice: Subject to any disclaimer, the term of this patent is extended or adjusted under 35 U.S.C. 154(b) by 0 days.

(21) Appl. No.: 09/818,368

(22) Filed: Mar. 27, 2001

(51) Int. Cl.[7] ..... B04B 9/10; B04B 11/08
(52) U.S. Cl. ..... 494/37; 494/58; 494/84
(58) Field of Search ..... 494/37, 50, 55, 494/56, 58–59, 65, 84; 210/372–377

(56) References Cited

U.S. PATENT DOCUMENTS

| | | | | |
|---|---|---|---|---|
| 1,117,195 | A | * | 11/1914 | Kopke |
| 2,370,999 | A | * | 3/1945 | Schutte |
| 3,092,582 | A | * | 6/1963 | Lacker |
| 3,403,848 | A | * | 10/1968 | Windsor et al. |
| 3,410,479 | A | | 11/1968 | Nilson |
| 3,741,465 | A | * | 6/1973 | Lincoln |
| 3,779,450 | A | * | 12/1973 | Shapiro |
| 3,986,663 | A | | 10/1976 | Johnson et al. |
| 5,328,441 | A | | 7/1994 | Carr |
| 5,551,940 | A | * | 9/1996 | Cote |
| 5,733,238 | A | | 3/1998 | Carr |
| 5,743,840 | A | | 4/1998 | Carr |
| 5,788,621 | A | * | 8/1998 | Eady |
| 5,902,224 | A | * | 5/1999 | Bloom |

FOREIGN PATENT DOCUMENTS

| | | |
|---|---|---|
| EP | 345178 | * 12/1989 |

* cited by examiner

*Primary Examiner*—Charles E. Cooley
(74) *Attorney, Agent, or Firm*—Donald J. Ersler

(57) ABSTRACT

A solid bowl centrifuge with liquid release during rotation includes a frame, solid bowl, drive device, scraper assembly, slurry spray, liquid collection trough, and speed control circuitry. The solid bowl includes a centrifuge chamber, and a liquid evacuation chamber. A plurality of openings are formed on the outer wall of the liquid evacuation chamber. The solid bowl is pivotal retained by the frame. The liquid collection trough is disposed around the liquid evacuation chamber. The drive device causes the solid bowl to rotate. The speed control circuit controls the speed of the drive device. Slurry is sprayed on to the wall of the centrifuge chamber while in rotation. The speed of the solid bowl is reduced to allow liquid to exit the centrifuge chamber through the liquid evacuation chamber into the liquid collection trough. The speed of the solid bowl is further reduced and the scraper assembly is activated to remove the solid material from the wall of the centrifuge chamber. The solid material falls out of the centrifuge chamber on to a conveyor or the like.

14 Claims, 3 Drawing Sheets

SOLID BOWL CENTRIFUGE WITH LIQUID RELEASE DURING ROTATION

BACKGROUND OF THE INVENTION

1. Field of the Invention

The present invention relates generally to centrifuges and more specifically to a solid bowl centrifuge with liquid release during rotation which does not require the solid bowl centrifuge to cease rotation to drain the liquid portion.

2. Discussion of the Prior Art

There are numerous designs of centrifuges disclosed in the art such as solid bowl and screen bowl. The centrifuges are used to separate the solid portion from the liquid portion in a slurry. Some of the solid bowl centrifuges include U.S. Pat. Nos. 5,328,441 and 5,733,238 to Carr. Some of the screen bowl centrifuges with side evacuation of liquid portions include U.S. Pat. No. 3,410,479 to Nilson and U.S. Pat. No. 3,986,663. Both the solid bowl and screen bowl centrifuges have drawbacks to their use. A solid bowl centrifuge is typically stopped to drain the separated liquid portion. Screen bowl centrifuges are relatively complex devices. However, it appears that neither design of centrifuge has been found suitable for use in the aggregate industry.

Accordingly, there is a clearly felt need in the art for a solid bowl centrifuge which is less complex than a screen bowl centrifuge, yet allows the liquid to be drained while the solid bowl is in rotation and provides ease of solids removal.

SUMMARY OF THE INVENTION

The present invention provides a solid bowl centrifuge which allows liquid to drain while the solid bowl is in rotation. The solid bowl centrifuge with liquid release during rotation includes a frame, solid bowl, drive device, scraper assembly, slurry spray unit, liquid collection trough, and speed control circuit. The solid bowl includes a centrifuge chamber, and a liquid evacuation chamber disposed below the centrifuge chamber. A drive shaft is formed through an axis of the solid bowl. A plurality of openings are formed through the wall of the liquid evacuation chamber. Preferably, the drive shaft is pivotally constrained by the frame on each end thereof.

The scraper assembly includes at least one scraper device and an actuation device. The scraper device includes a scraper blade at least two scraper arms, an actuation arm, and a pivot rod. One end of each of the scraper arms is attached to the pivot rod and the other end is attached to the scraper blade. One end of the actuation arm is attached to the pivot rod and the other end is pivotally attached to the actuation device.

Preferably, a tubular post extends upward from a bottom of the frame and around the drive shaft. The pivot rod is pivotally attached to the tubular post. The slurry spray unit is disposed on the inside of the centrifuge chamber. The liquid collection trough is disposed around and under the liquid evacuation chamber. The drive device causes the drive shaft to rotate. The speed control circuit controls the speed of the drive device.

The solid bowl centrifuge with liquid release during rotation preferably operates in the following manner. Preferably, a predetermined amount of slurry is sprayed on the wall of the centrifuge chamber while rotating. The solid bowl is rotated for a period of time. Next, the speed of the solid bowl is reduced to allow liquid to drain from the centrifuge chamber. The liquid whips around an opening in a partition between the centrifuge chamber and liquid evacuation chamber. The liquid continues to the wall of the liquid evacuation chamber and through a plurality of openings formed in the wall. The liquid is collected in the liquid collection trough and drained therefrom. Next, the speed of the solid bowl is further reduced and the scraper assembly is activated to remove the solid material from the wall of the centrifuge chamber. The solid portion falls out of the centrifuge chamber on to a conveyor or the like. After the solid portion is removed from the wall of the centrifuge chamber, the speed of the solid bowl is increased and the process is repeated.

Accordingly, it is an object of the present invention to provide a solid bowl centrifuge which is less complex than a screen bowl centrifuge.

It is a further object of the present invention to provide a solid bowl centrifuge which allows liquid to be drained while the solid bowl is in rotation.

Finally, it is another object of the present invention to provide a solid bowl centrifuge which provides ease of solids removal.

These and additional objects, advantages, features and benefits of the present invention will become apparent from the following specification.

DETAILED DESCRIPTION OF THE PREFERRED EMBODIMENTS

Figure 1:
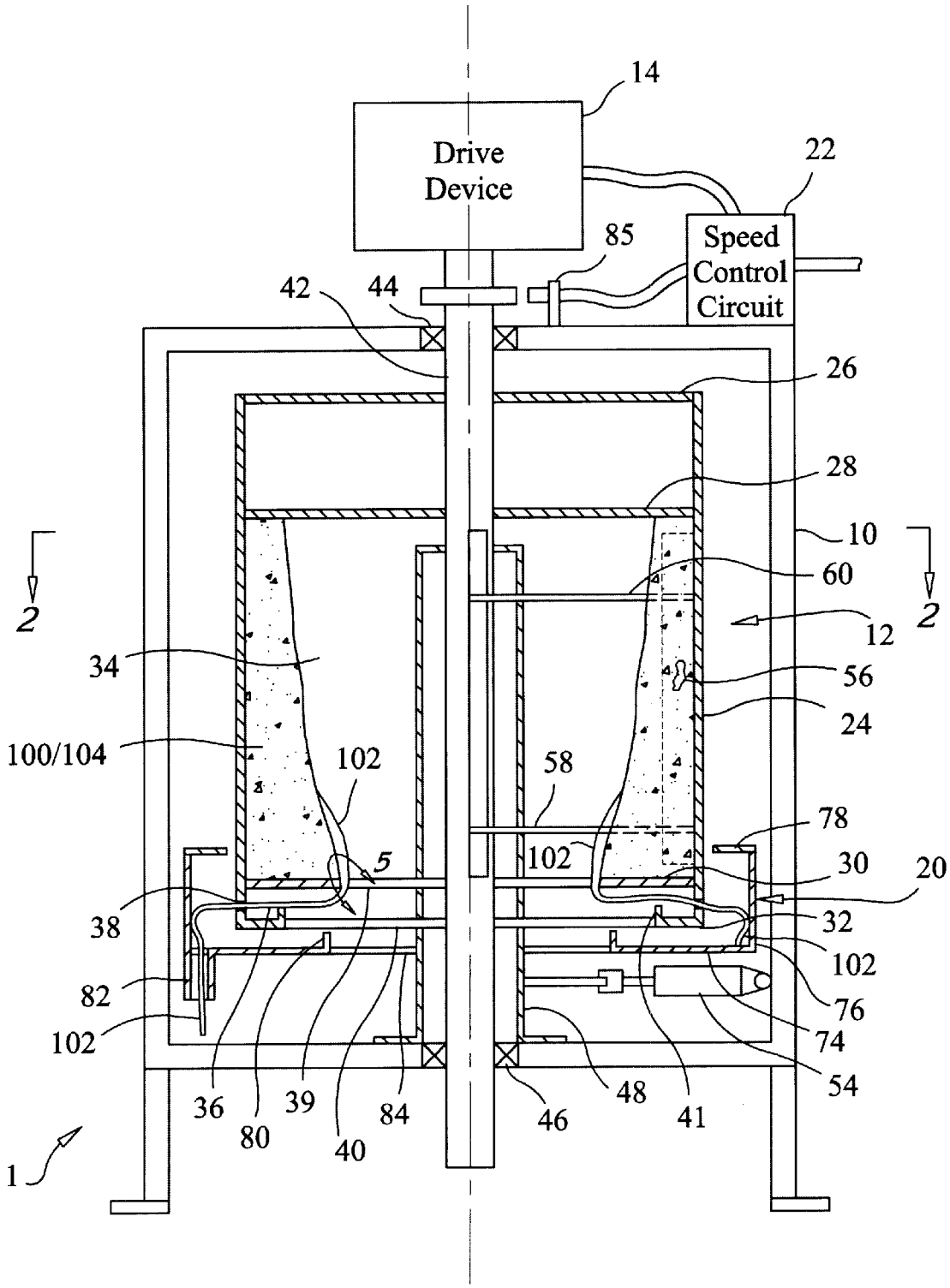
FIG. 1 is a cross sectional view of a solid bowl centrifuge with liquid release during rotation in accordance with the present invention.
Figure 2:
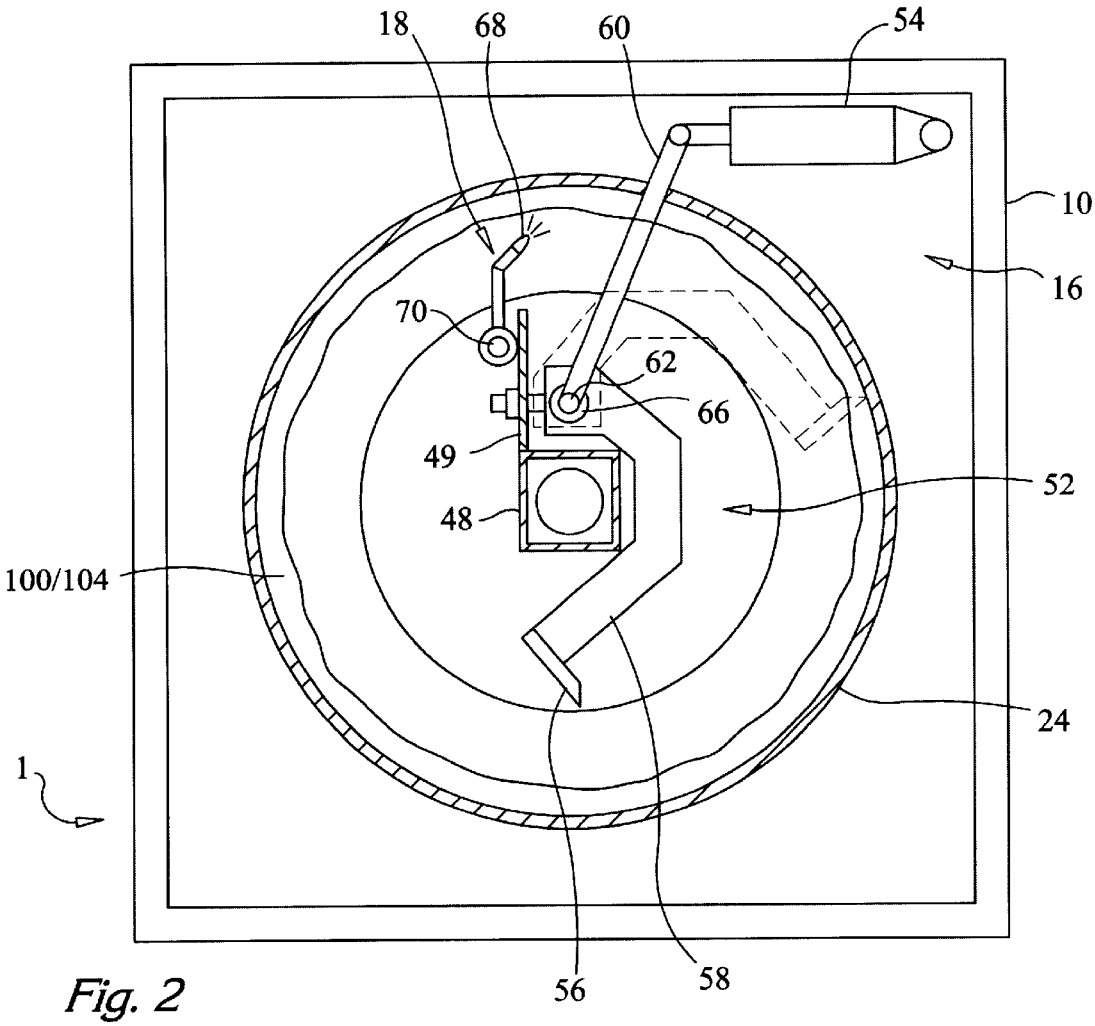
FIG. 2 is a sectional view taken along line Z—Z of FIG. 1 of a solid bowl centrifuge with liquid release during rotation in accordance with the present invention.
Figure 3:
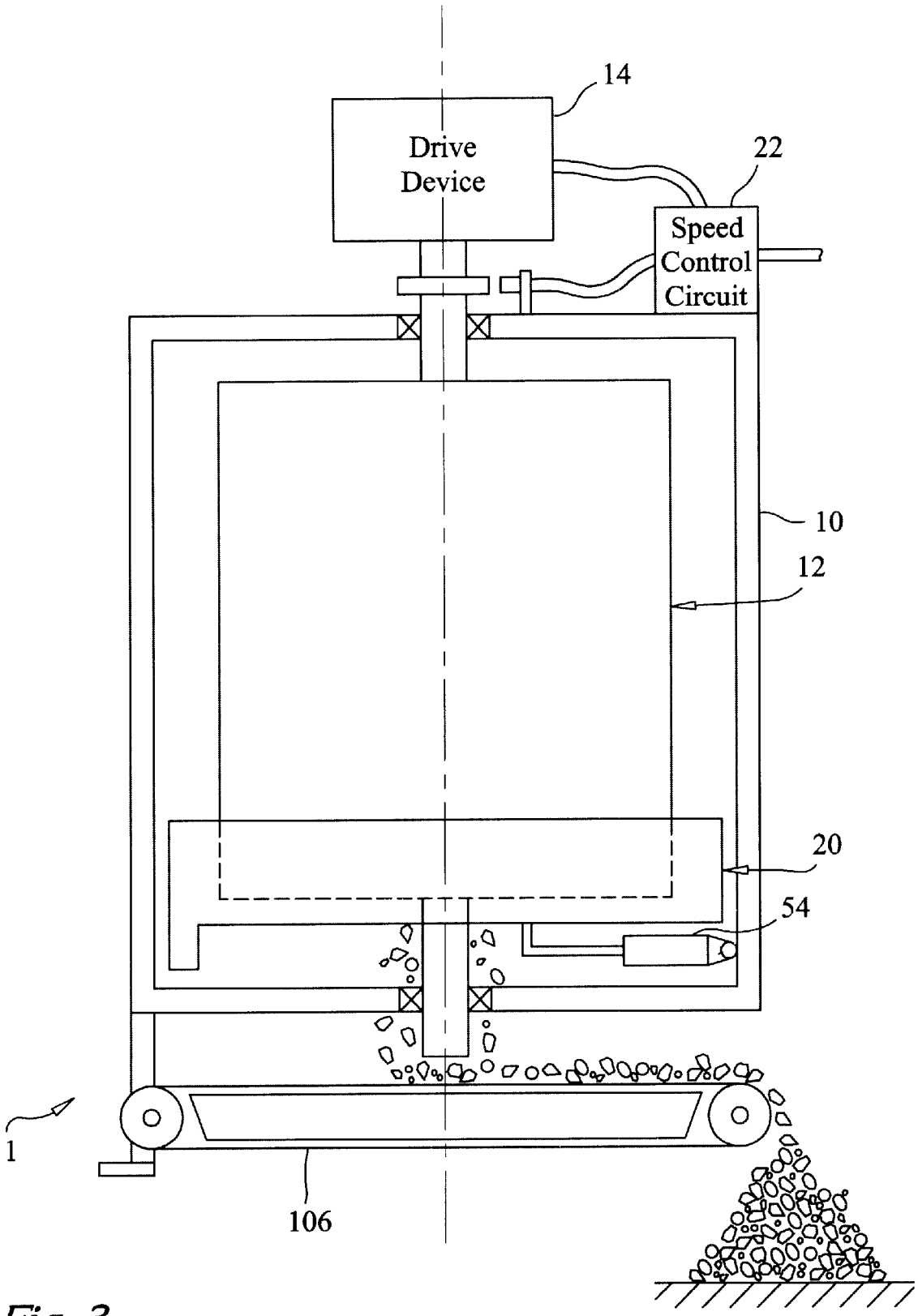
FIG. 3 is a side view of a solid bowl centrifuge with liquid release during rotation in accordance with the present invention.

With reference now to the drawings, and particularly to FIG. 1, there is shown a cross sectional view of a solid bowl centrifuge with liquid release during rotation 1. With reference to FIGS. 2–3, the solid bowl centrifuge with liquid release during rotation 1 includes a frame 10, solid bowl 12, drive device 14, scraper assembly 16, slurry spray unit 18, liquid collection trough 20, and speed control circuit 22. The solid bowl 12 preferably includes a wall 24, a top plate 26, a top centrifuge plate 28, a bottom centrifuge plate 30, and a bottom plate 32. The wall 24 is terminated on a top with the top plate 26 and on a bottom thereof with a bottom plate 32. The top centrifuge plate 28 is attached to the wall 24 below the top plate 26. The bottom centrifuge plate 30 is attached to the wall 24 above the bottom plate 32. The area between the top and bottom centrifuge plates define a centrifuge chamber 34. The area between the bottom centrifuge plate 30 and the bottom plate 32 define a liquid evacuation chamber 36. A plurality of openings 38 are formed through the wall 24 adjacent the liquid evacuation chamber 36. A liquid opening 39 is formed through the bottom centrifuge plate 30. A solids opening 40 is formed through the bottom plate 32. A solids lip 41 preferably extends upward from a perimeter of the solids opening 40.

A drive shaft 42 is formed through an axis of the solid bowl 12. A first opening is formed through the top plate 26 and a second opening is formed through the top centrifuge plate 28. The first and second openings are sized to provide clearance for the drive shaft 42. The drive shaft 42 is attached to the top plate 26 and the top centrifuge plate 28 with any suitable assembly method. Preferably, a first shaft bearing 44 is formed in a top of the frame 10 and a second shaft bearing 46 is formed in a bottom of the frame 10.

Preferably, a tubular post 48 extends upward from a bottom of the frame 10. The drive shaft 42 extends through a center of the tubular post 48. An attachment plate 49 extends from a length of the tubular post 48. The scraper assembly 16 preferably includes at least one scraper device 52 and an actuation device 54. The scraper device 52 includes a scraper blade 56, at least two scraper arms 58, an actuation arm 60, and a pivot rod 62. One end of each of the scraper arms 58 are firmly attached to the pivot rod 62 and the other end is attached to the scraper blade 56. The scraper blade 56 preferably extends the axial length of the centrifuge chamber 34. One end of the actuation arm 60 is firmly attached to the pivot rod 62 and the other end is pivotally attached to an actuation end of the actuation device 54. The other end of the actuation device 54 is preferably pivotally attached to the frame 10. The actuation device 54 is preferably a hydraulic cylinder, but other devices may also be used. The pivot rod 62 is preferably pivotally attached to the attachment plate 49 with at least two rod end bearings 66 or any other suitable method or device.

Figure 4:
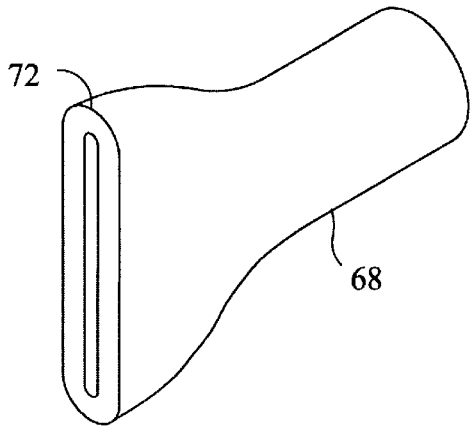
FIG. 4 is a perspective view of a spray nozzle of a solid bowl centrifuge with liquid release during rotation in accordance with the present invention.

The slurry spray unit 18 includes at least one spray nozzle 68 and a delivery tube 70. The at least one spray nozzle 68 is attached to the delivery tube 70. Preferably, the at least one spray nozzle 68 sprays at an acute angle relative to the wall 24. With reference to FIG. 4, the spray nozzle 68 preferably has a flared outlet 72. The flared outlet 72 improves the distribution of slurry applied to the inner wall of the centrifuge chamber 34. Slurry 100 is pumped into the delivery tube 70 from an external source. The delivery tube 70 is preferably attached to the attachment plate 49 with any suitable method.

The liquid collection trough 20 preferably includes a base plate 74, a splash wall 76, a top splash guard 78, a liquid splash lip 80, and at least one drain opening 82. The splash wall 76 is attached to a top of the base plate 74 and the top splash guard 78 is mounted to a top of the splash wall 76. A solid material opening 84 is formed through the base plate 74. The radial splash guard 80 extends upward from a top of the base plate 74 adjacent the material opening 84. The base plate 74 is preferably pitched such that any liquid which pools near the radial splash guard 80 runs to an outside perimeter of the base plate 74. Liquid exits the liquid collection trough 20 through the at least one drain opening 82. The drain opening 82 is connected to any suitable external location.

The solid bowl 12 is rotated by a drive device 14. The drive device 14 is preferably an electric motor, but other devices may also be used. The speed control circuit 22 is preferably a microprocessor based circuit which provides electrical control to the drive device 14. The speed control circuit 22 preferably monitors the speed of the solid bowl 12 with an inductive pick-up 85. The speed of the solid bowl 12 is controlled by varying electrical power sourced to the drive device 14.

The solid bowl centrifuge with liquid release during rotation 1 preferably operates in the following manner. The following parameters are given by way of example and not by way of limitation. The parameters provided have been found to produce satisfactory results. Other parameter values may also provide satisfactory results. Preferably, a predetermined amount of slurry 100 is sprayed on to the inner wall of the centrifuge chamber 34 while the solid bowl is rotated to provide a centripetal force of 250–500 g's for between 1–3 minutes. The amount of slurry 100 sprayed on the inner wall is provided by opening a valve for a specified amount of time or by metering a specific amount of slurry 100.

Figure 5:
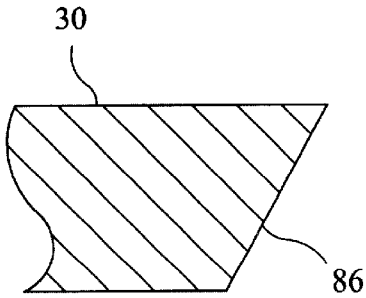
FIG. 5 is an enlarged cross sectional view of an edge of a liquid opening in a bottom centrifugal plate of a solid bowl centrifuge with liquid release during rotation in accordance with the present invention.

Next, the speed of the solid bowl 10 is reduced to provide a centripetal force of 0.5–3 g's for a period of 30–90 seconds. The liquid portion 102 will drain from an inner surface of the solid portion 104. The liquid portion 102 will whip around an edge of the liquid opening 39 formed in the bottom centrifuge plate 30. With reference to FIG. 5, preferably a tapered edge 86 is formed on the periphery of the liquid opening 39 to aid in the travel of the liquid portion 102. The liquid portion 102 will exit through the plurality of openings 38. The liquid portion 102 will strike the splash wall 76 and drain through the at least one drain opening 82.

Next, the speed of the solid bowl 10 is preferably further reduced to provide a centripetal force of 0–0.5 g's for a period of 20–60 seconds. The scraper assembly 16 is activated to remove the solid portion 104 from the inner wall of the centrifuge chamber 34. The solid portion 104 falls out of the centrifuge chamber 34 through the solids and liquid openings on to a conveyor 106 or the like. After all the solid portion 104 is removed, the speed of the solid bowl 12 is increased and the process is repeated.

The superior performance of the solid bowl centrifuge with liquid release during rotation for separating the liquid portion of a slurry from the solid portion reduces the need to mix the slurry with a flocculent to thicken thereof.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of separating solid and liquid portions of a slurry comprising the steps of:

(a) providing a rotatable centrifuge chamber having an interior wall and a lower portion;

(b) providing a liquid evacuation chamber fixedly attached to said lower portion of said rotatable centrifuge chamber for rotation therewith, forming a liquid opening between said rotatable centrifuge chamber and said liquid evacuation chamber, forming a plurality of openings through a wall of said liquid evacuation chamber;

(c) providing a pivoting scraper assembly in said rotatable centrifuge chamber;

(d) rotating said rotatable centrifuge chamber at a speed sufficient to separate the solid and liquid portions in the slurry; and (e) decreasing the speed of said rotatable centrifuge chamber such that the liquid portion of the slurry whips around an edge of said liquid opening into said liquid evacuation chamber, the liquid portion exiting said liquid evacuation chamber through said plurality of openings.

2. The method of separating solid and liquid portions of a slurry of claim 1, further comprising the steps of:

(f) capturing the liquid portion exiting through said plurality of openings and directing thereof to an external location.

3. The method of separating solid and liquid portions of a slurry of claim 2, further comprising the step of:

(g) further decreasing the speed of said rotatable centrifuge chamber; and activating said pivoting scraper assembly to scrape the solid portion from said interior wall such that the solid portion will fall out of said rotatable centrifuge chamber.

4. The method of separating solid and liquid portions of a slurry of claim 1, further comprising the step of:

(f) spraying slurry on to the interior wall of said rotatable centrifuge chamber.

5. The method of separating solid and liquid portions of a slurry of claim 4, further comprising the step of:

(g) spraying slurry on to said interior wall of said rotatable centrifuge chamber through at least one spray nozzle and a delivery tube.

6. The method of separating solid and liquid portions of a slurry of claim 5, further comprising the step of:

(h) flaring an outlet of each said at least one spray nozzle.

7. The method of separating solid and liquid portions of a slurry of claim 1, further comprising the step of:

(f) providing a liquid collection trough disposed adjacent said plurality of openings, said liquid collection trough collecting liquid supplied through said plurality of openings, the liquid being drained from said liquid collection trough.

8. The method of separating solid and liquid portions of a slurry of claim 1, further comprising the step of:

(f) providing a speed control circuit for controlling the speed of said rotatable centrifuge chamber through a drive device.

9. A method of separating solid and liquid portions of a slurry comprising the steps of:

(a) providing a rotatable centrifuge chamber having an interior wall and a lower portion;

(b) providing a liquid evacuation chamber fixedly attached to said lower portion of said rotatable centrifuge chamber for rotation therewith, forming a liquid opening between said rotatable centrifuge chamber and said liquid evacuation chamber, forming a plurality of openings through a wall of said liquid evacuation chamber;

(c) providing a pivoting scraper assembly in said rotatable centrifuge chamber;

(d) spraying slurry on to the interior wall of said rotatable centrifuge chamber;

(e) rotating said rotatable centrifuge chamber at a speed sufficient to separate the solid and liquid portions in the slurry;

(f) decreasing the speed of said rotatable centrifuge chamber such that the liquid portion of the slurry whips around an edge of said liquid opening into said liquid evacuation chamber, the liquid portion exiting said liquid evacuation chamber through said plurality of openings; and (g) capturing the liquid portion exiting through said plurality of openings and directing thereof to an external location.

10. The method of separating solid and liquid portions of a slurry of claim 9, further comprising the step of:

(h) further decreasing the speed of said rotatable centrifuge chamber; and activating said pivoting scraper assembly to scrape the solid portion from said interior wall such that the solid portion will tall out of said rotatable centrifuge chamber.

11. The method of separating solid and liquid portions of a slurry of claim 9, further comprising the step of:

(h) spraying slurry on to said interior wall of said rotatable centrifuge chamber through at least one spray nozzle and a delivery tube.

12. The method of separating solid and liquid portions of a slurry of claim 11, further comprising the step of:

(i) flaring an outlet of each said at least one spray nozzle.

13. The method of separating solid and liquid portions of a slurry of claim 9, further comprising the step of:

(h) providing a liquid collection trough disposed adjacent said plurality of openings, said liquid collection trough collecting liquid supplied through said plurality of openings, the liquid being drained from said liquid collection trough.

14. The method of separating solid and liquid portions of a slurry of claim 13, further comprising the step of:

(h) providing a speed control circuit for controlling the speed of said rotatable centrifuge chamber through a drive device.

* * * * *